US007034648B2

(12) United States Patent
Shirahata et al.

(10) Patent No.: US 7,034,648 B2
(45) Date of Patent: Apr. 25, 2006

(54) AMORPHOUS METAL CORE TRANSFORMER

(75) Inventors: Toshiki Shirahata, Shibata (JP); Masayuki Horiuchi, Niigata-ken (JP); Katsutoshi Inagaki, Niigata (JP); Shinya Urata, Niigata-ken (JP)

(73) Assignee: Hitachi, Ltd., Tokyo (JP)

( * ) Notice: Subject to any disclaimer, the term of this patent is extended or adjusted under 35 U.S.C. 154(b) by 600 days.

(21) Appl. No.: 09/825,339

(22) Filed: Apr. 4, 2001

(65) Prior Publication Data

US 2001/0033216 A1 Oct. 25, 2001

Related U.S. Application Data

(63) Continuation of application No. 09/363,836, filed on Jul. 30, 1999, now Pat. No. 6,750,749.

(30) Foreign Application Priority Data

Jul. 31, 1998 (JP) ..... 10-216755

(51) Int. Cl.
*H01F 27/28* (2006.01)

(52) U.S. Cl. ..... 336/220

(58) Field of Classification Search ..... 336/210–213, 336/216, 223, 234, 57, 58, 61, 60, 69, 233, 336/220, 221
See application file for complete search history.

(56) References Cited

U.S. PATENT DOCUMENTS

| | | | | |
|---|---|---|---|---|
| 3,200,357 A | | 8/1965 | Olson et al. | |
| 3,464,043 A | * | 8/1969 | Benko et al. | 336/60 |
| 3,617,966 A | | 11/1971 | Trench | |
| 3,659,239 A | | 4/1972 | Marton | |
| 3,750,073 A | | 7/1973 | Okano | |
| 4,327,311 A | | 4/1982 | Wroblewski | |
| 4,368,407 A | | 1/1983 | Wroblewski | |
| 4,523,169 A | * | 6/1985 | Hay | 336/60 |
| 4,609,900 A | | 9/1986 | Bachhofer et al. | |
| 5,225,630 A | | 7/1993 | Hopkinson et al. | |
| 5,889,373 A | | 3/1999 | Fisher et al. | |
| 6,005,468 A | | 12/1999 | Shirahata et al. | |

FOREIGN PATENT DOCUMENTS

| | | |
|---|---|---|
| JP | 60-178609 | 9/1985 |
| JP | 60-178609 | * 12/1986 |
| JP | 04-155907 | * 5/1992 |
| JP | 06163283 | 6/1994 |
| JP | 08031667 | 2/1996 |
| JP | 9-254494 | 9/1997 |
| JP | 10-340815 | 12/1998 |
| WO | WO8302194 | 6/1983 |

* cited by examiner

*Primary Examiner*—Tuyen T Nguyen
(74) *Attorney, Agent, or Firm*—Mattingly,Stanger,Malur & Brundidge, P.C.

(57) ABSTRACT

An amorphous metal core transformer is provided with a plurality of wound magnetic cores composed of amorphous metal strips, and a plurality of coils, each of the coils including a primary coil and a secondary coil, each of the coils further including a bobbin. The primary coil employs different material from that of the secondary coil, e.g., a copper conductor is employed in a primary coil, while an aluminum conductor is employed in a secondary coil. The bobbin has higher strength than that of the amorphous metal strips.

2 Claims, 11 Drawing Sheets

AMORPHOUS METAL CORE TRANSFORMER

This application is a continuation application of U.S. Ser. No. 09/363,836, filed Jul. 30, 1999 now U.S. Pat. No. 6,750,749.

BACKGROUND OF THE INVENTION

This invention relates to an amorphous metal core transformer, and particularly relates to an amorphous metal core transformer capable of reducing core losses and watt losses.

An amorphous metal core transformer, which transforms A.C. power of a high voltage and a small amperage into that of a low voltage and a large amperage, or vise versa, using amorphous metal sheets as for a material of its magnetic core, is so popular nowadays. As for the magnetic core of the amorphous metal core transformer, a wound core or a laminated core is employed. The wound core is chiefly employed and it is formed by winding amorphous metal strips. For example, as disclosed in Japanese Patent Applications Nos. Hei 9-149331 (Japanese Patent Laid-open No. JP-A-10-340815) and JP-A-9-254494, an amorphous metal core transformer for three phase 1000 kVA use with five-legged core, employs wound cores and coils in a transformer casing. In actual designing of the transformer in these related arts, amorphous magnetic strips are wound to form a unit core of approximately 170 mm in width and approximately 16200 $mm^2$ in cross-sectional area. Two unit cores are juxtaposed edgewise to compose a set of unit cores to increase (in this case, to double) the cross-sectional area. Four sets of unit cores are arranged side by side so as to compose a five-legged core. Three coils are combined with the five-legged core so as to compose the three phase transformer. The five-legged core has first leg, second leg, third leg, fourth leg and fifth leg arranged in this order. The coils consist of three coils, which are first coil, second coil and third coil and are inserted in the second leg, the third leg and the fourth leg respectively. Actual weight of the inner unit cores and outer unit cores are about 158 kg and about 142 kg respectively.

Coils in an amorphous transformer according to the related art, as shown in FIG. 4B, are composed of a primary coil 121 and a secondary coil 122 for three phases. The primary coil 121 uses a rectangular insulated copper wire measuring 3.5 mm×7.0 mm, having a conductor cross-sectional area of 24.5 $mm^2$, which is wound 418 turns. The secondary coil 122 uses two parallel copper conductor strip having a conductor cross-sectional area of 603.5 $mm^2$, which is wound 13 turns. The primary coil 121 is arranged outside the secondary coil 122 in the radial direction of the coil. In order to let out the heat generated inside the coils, duct space layers 24 are formed within the coils 2 for circulating insulation oil therein. In each of the duct space layers, a spacer members having a plurality of rod-shaped members 23 shown in FIG. 4C, is inserted so as to form a loop within the coil. Since the amorphous metal core transformer in the related art has large losses, a sufficient cooling capacity is required for the duct space layers 24. Accordingly, six duct space layers 24 are disposed both between the second leg and the third leg and between the third leg and the fourth leg. Since the duct layers 24 are formed in coaxial loops, both coil ends of the coil 2 is disposed facing the cores by narrow gaps, which impedes circulation of insulation oil.

In general, a transformer is designed in such a manner that the current density in the primary coil and that in the secondary coil are nearly equal as possible and, when different conductor materials are used for the two coils, the current densities calibrated by electrical resistances of the coils are also nearly equal. Further, as connection systems for three phase transformers, Y (star) connection and Δ (delta) connection are known. When the capacity of the transformer is small, Δ connection is disadvantageous because a greater number of turns are required than that required in Y connection. On the other hand, when the capacity of the transformer is in the medium range or above, Y connection is disadvantageous because a wider cross-sectional area of the conductor is required than that required in Δ connection. Therefore, in the small capacity range of 500 kVA or less, Y-Δ connection is used, and in the medium capacity of 750 kVA or more, Δ—Δ connection is mainly used. And in the latter, some transformers use Y-Δ connection. Where Y connection is used, it is possible to reduce the turns of the coil windings $1/\sqrt{3}$ times to that in Δ connection. However, the amperage of the current flowing through the coil is the same value as that in Δ connection, which requires the same cross-sectional area of the coil conductor as that in Δ connection. On the other hand, though Δ connection requires the turns of the coil windings $\sqrt{3}$ times to that in Y connection, amperage of the current flowing through the coil is reduced to $1/\sqrt{3}$ times to that in Y connection, which enables to reduce the cross-sectional area of the coil conductor.

An magnetic core-coil assembly, as shown in FIGS. 7 and 8 of the JP-A-10-340815, is composed of eight unit magnetic cores and three coils. The unit magnetic core has a joint portion in one of its yokes, and when this joint portion is opened, the core is formed into U-shape so as to be able to insert its legs into the coils. After insertion, the joint portion is closed and the magnetic core and the coil are assembled.

A transformer casing has a similar configuration to one shown in FIG. 3, which accommodates the magnetic core-coil assembly and insulating oil inside, and has external terminals, cooling fins outside. The external terminals are electrically connected to the coils through line wires. The cooling fins radiate the heat generated in the coils or magnetic cores and the heat transmitted to the insulating oil into the atmosphere to keep the temperature increase within an allowable range. The height of the cooling fins is designed to be approximately 100 to 200 mm. The total surface area of the cooling fins is supposed to be about 10 times as large as the surface area of the casing, and is designed to be approximately 50 $m^2$.

In case of a conventional amorphous metal core transformer for three phase 1000 kVA use, total losses will amount to approximately 11730 W including core losses of approximately 330 W and watt losses of approximately 11400 W, which requires a large cooling area to keep the temperature increase within the allowable range. In addition, if loss reduction is attempted by reducing the watt losses so as to increase the conductor cross-sectional areas of the primary and secondary coils, it is necessary to use thicker, accordingly more rigid copper wires. This makes the winding work more difficult due to rigidity of the wires, and in addition, connection between the secondary coil and the line wire becomes more difficult, which deteriorates productivity requiring more man-hours.

SUMMARY OF THE INVENTION

It is therefore an object of the present invention to solve the problems of the related art explained above. In view of the objective of solving the problems explained above, the construction of the amorphous metal core transformer includes a plurality of wound magnetic cores composed of amorphous metal strips, and a plurality of coils, each of the coils including a primary coil and a secondary coil, each of the coils further including a bobbin, wherein the primary coil employs different material from that of the secondary coil, and the bobbin has higher strength than that of the amorphous metal strips.

In another embodiment of the amorphous metal core transformer, the primary coil is composed of copper conductor coil, the secondary coil is composed of aluminum conductor coil, and the secondary coil is disposed outside the primary coil in radius direction of the coil.

In the third embodiment of the amorphous metal core transformer, current density calibrated by electrical resistance of the primary coil is higher than that of the secondary coil.

In the fourth embodiment of the amorphous metal core transformer, the secondary coil has a greater length than the primary coil in the axial direction thereof.

In the fifth embodiment of the amorphous metal core transformer, the primary coil employs a rectangular copper wire, and the secondary coil employs an aluminum strip.

In fifth embodiment, the amorphous metal core transformer further includes a casing for containing the magnetic cores and the coils, the casing being filled with an insulative cooling medium, the casing having cooling fins formed so as to project from a surface of the casing, wherein, the cooling fins project from the surface of the casing from 17 mm to 280 mm in height, and the total surface area of the cooling fins and the casing is 130 $m^2$ or less.

In sixth embodiment of the amorphous metal core transformer, four pieces of the wound magnetic cores and three pieces of the coils are assembled so as to compose a three phase transformer having five-legged magnetic cores.

In seventh embodiment of the amorphous metal core transformer, the three phase transformer has a capacity of 750 kVA or more and the three coils are connected in Δ—Δ connection system.

The present invention provides an amorphous metal core transformer capable of reducing a total losses resulting in a reduction of temperature increase and size of cooling fins. The present invention also provides an amorphous metal core transformer capable of improving productivity.

BRIEF DESCRIPTION OF THE DRAWINGS

The foregoing and a better understanding of the present invention will become apparent from the following detailed description of exemplary embodiments and the claims when read in connection with the accompanying drawings, all forming a part of the disclosure hereof this invention. While the foregoing and following written and illustrated disclosure focuses on disclosing exemplary embodiments of the invention, it should be clearly understood that the same is by way of illustration and example only and is not to be taken by way of limitation, the spirit and the scope of the present invention being limited only by the terms of the appended claims.

The following represents brief descriptions of the drawings, wherein:

FIG. 4A shows a layout of the duct space layers in the embodiment. FIG. 4B shows a layout of the duct space layers in the related art. FIG. 4C shows a spacer member in the embodiment.

In FIG. 8, (*a*) through (*g*) show first step through seventh step of the assembling process, respectively.

In FIG. 11, (*a*) through (*g*) show first step through seventh step of the assembling process, respectively.

In FIGS. 13, (*a*) shows a perspective view of the protection number when attached to the coils, and (*b*) shows a details of a corner portion of a coil window.

In FIGS. 14, (*a*) shows a perspective view of the protection member when attached to the coils, and (*b*) shows a details of a corner portion of a coil window.

DESCRIPTION OF THE EMBODIMENTS

Figure 1:
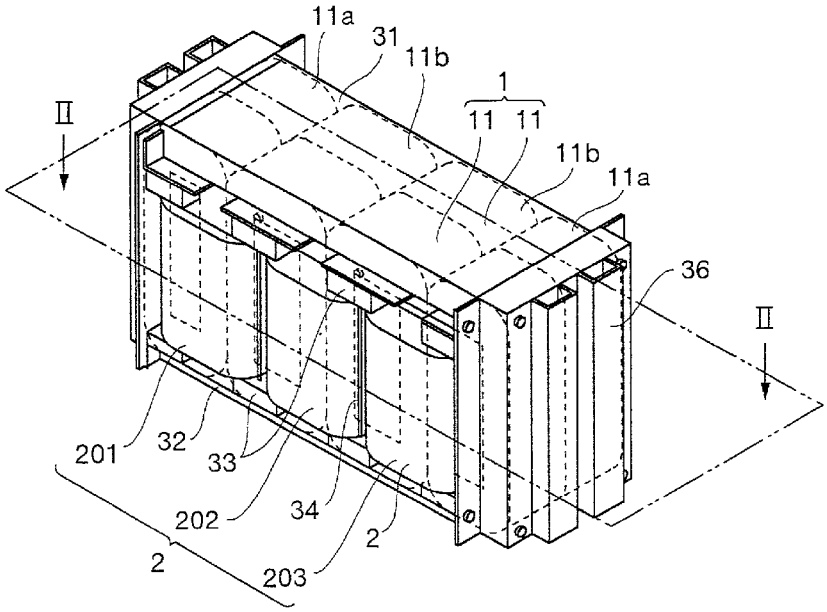
FIG. 1 shows a perspective view of an magnetic core-coil assembly with clamps for an amorphous metal core transformer in one embodiment of the present invention.
Figure 2:
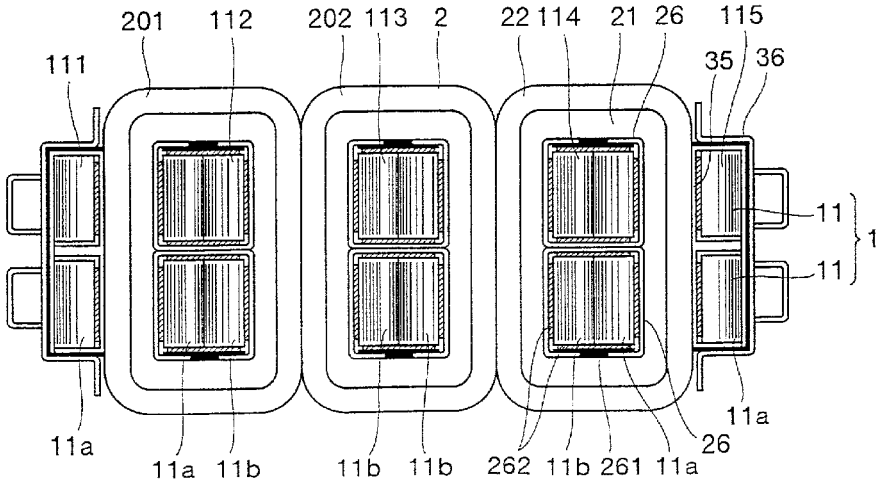
FIG. 2 shows a horizontal cross-sectional view in the plane II—II of the magnetic core-coil assembly in the embodiment.
Figure 3:
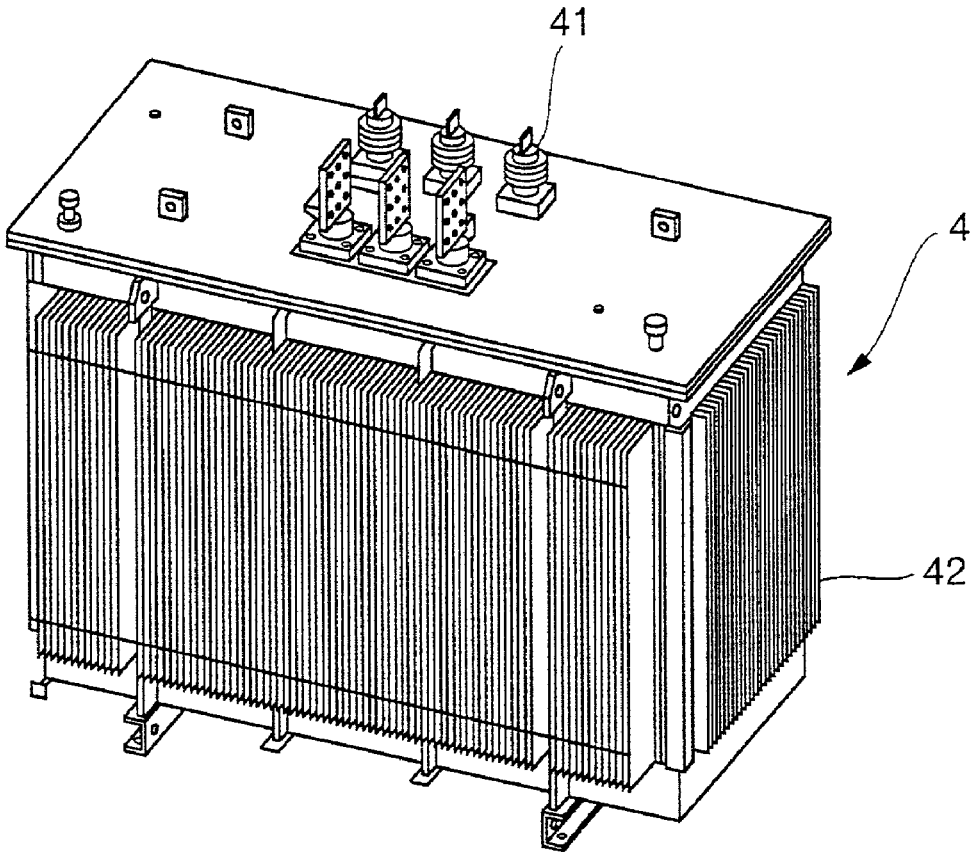
FIG. 3 shows a perspective view of the external appearance of the amorphous metal core transformer of the embodiment.

Before beginning a detailed description of the subject invention, mention of the following is in order. When appropriate, like reference numerals and characters are used to designate identical, corresponding or similar components in differing figure drawings.

One embodiment of the amorphous metal core transformer of the present invention will be described with reference to FIGS. 1 to 15.

An amorphous metal core transformer of the present embodiment is a transformer with five-legged magnetic cores for three phase 1000 kVA, 50 Hz use, having wound magnetic cores 1, coils 2, and a transformer casing 4. In the present embodiment, an magnetic core-coil assembly 3 is composed by assembling four wound magnetic cores 1 and three coils 2. As shown in FIG. 1, each magnetic core 1 is composed of two unit cores 11. Two unit cores 11 are juxtaposed edgewise to compose a magnetic core 1 to increase (in this case, to double) the cross-sectional area.

Four magnetic cores 1 are arranged side by side so as to compose a five-legged core. In this embodiment, eight unit cores 11 are totally employed to compose the five-legged core. Three coils 2 are combined with the five-legged core so as to compose a magnetic core-coil assembly 3. The five-legged core has first leg 111, second leg 112, third leg 113, fourth leg 114 and fifth leg 115 arranged in this order (In FIGS. 1 and 2, from left to right). Three sets of coils 2, which are first coil 201, second coil 202 and third coil 203 (In FIGS. 1 and 2, from left to right), are inserted in the second leg 112, the third leg 113 and the fourth leg 114 respectively. Thus, by combining eight unit cores 11 in total with three sets of coils 2, the magnetic core-coil assembly 3 is composed. The magnetic core-coil assembly 3 is installed in the transformer casing 4. The core-coil assembly 3 is set between an upper clamp 31 and a lower clamp 32, and the upper clamp 31 and the lower clamp 32 are fastened by studs 34. Each of the coils 2 is placed between the upper clamp 31 and the lower clamp 32. Coil supports 33 support the coil 2 between the upper clamp 31 and the lower clamp 32 at the upper end and the lower end of the coil 2. Each of the first leg and the fifth leg is enclosed in a set of U-shaped clamp 35 and an E-shaped clamp 36. These sets of the U-shaped clamp 35 and the E-shaped clamp 36 are combined to the upper clamp 31 and the lower clamp 32 so as to keep the positional relationships between individual magnetic cores 1 and individual coils 2. For wire connection, a Δ—Δ connection system is adopted among the three coils 2. Then, an insulative cooling medium (in this embodiment, insulating oil) is filled into the transformer casing 4, and the three phase amorphous metal core transformer is composed. Incidentally, the insulative cooling medium may be such insulating gas as $SF_6$ (sulfur hexafluoride) or $N_2$ (nitrogen).

Figure 7:
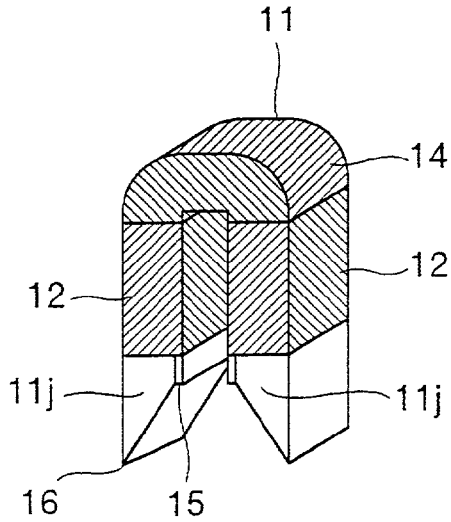
FIG. 7 shows a perspective view of the unit core in the embodiment.

The unit core 11 is composed by cutting amorphous magnetic strip of approximately 170 mm in width to a prescribed length beforehand, stacking a prescribed number of pieces of the pre-cut amorphous strip into a core of approximately 16800 $mm^2$ in cross-sectional area and placing it on a mandrel, forming it into a U shaped open-ended core as shown in FIG. 7 and annealing after closing its ends. After annealing, the core 11 is covered with a fragment prevention member 12, 14 as shown in FIG. 7, then, the ends are opened and its legs are inserted into the coil 2. After the legs are inserted into coils 2, the opened ends are closed so as to form a butted joint. Greater core cross-sectional area than that of a conventional core is gained for the unit core 11 in this embodiment. By juxtaposing two unit cores 11 edgewise, a cross-sectional area of about 33600 $mm^2$ for each magnetic core 1, approximately 3.7% greater than in a conventional core, is gained, which enables to reduce the magnetic resistance, and to obtain an magnetic core with reduced core losses. The first coil 201 is inserted into the core window between the first leg 111 and the second leg 112, and the third coil 203 is inserted into the core window between the fourth leg 114 and the fifth leg 115. The first coil 201 and the second coil 202 are inserted into the core window between the second leg 112 and the third leg 113, and the second coil 202 and the third coil 203 are inserted into the core window between the third leg 113 and the fourth leg 114.

Among amorphous magnetic strips industrially manufactured at present, those usable for transformers are approximately 0.025 mm in thickness and at most approximately 213 mm in width. If this kind of strip is applied to a large capacity transformer of three phase 1000 kVA class for power distribution use, desirable magnetic core width is estimated to be about 400 mm. Amorphous magnetic strips industrially manufactured at present are available in three different widths, i.e., 142 mm, 170 mm and 213 mm. Among the three widths, 170 mm wide strips are currently distributed in greatest volume and more readily available for industrial use. Therefore, two unit cores 11, using 170 mm wide magnetic strip, are juxtaposed edgewise so as to obtain the cross-sectional area of approximately 16800 $mm^2$ in the present embodiment. In addition, the amorphous magnetic strip has a high hardness level of 900 to 1000 HV, and is a very brittle material as well. For this reason, in manufacturing large capacity transformers for power distribution use industrially, it is an essential point to compose a large cross-sectional area core by combining small cross-sectional area cores, which reduces the masses of unit cores 11, and improves workability. Then, assembly into the coil configuration, which is described later, makes the mass of the outer unit core outside 11*a* about 173 kg and the mass of the inside unit core 11*b* about 197 kg. As the magnetic core 1 of the present embodiment generates little heat thanks to low core losses, and also has a large area of contact with the cooling medium, i.e. insulating oil in this embodiment, by virtue of the five-legged iron core, magnetic cores and a transformer with little temperature rise can be obtained.

Figure 4A:
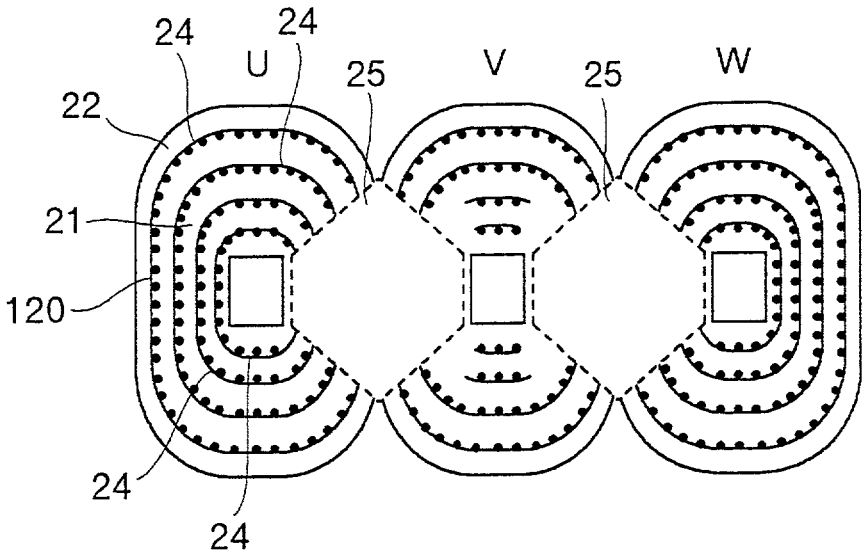
FIGS. 4A, 4B and 4C show diagrams illustrating layouts of duct space layers in coils of the amorphous metal core transformer.
Figure 4B:
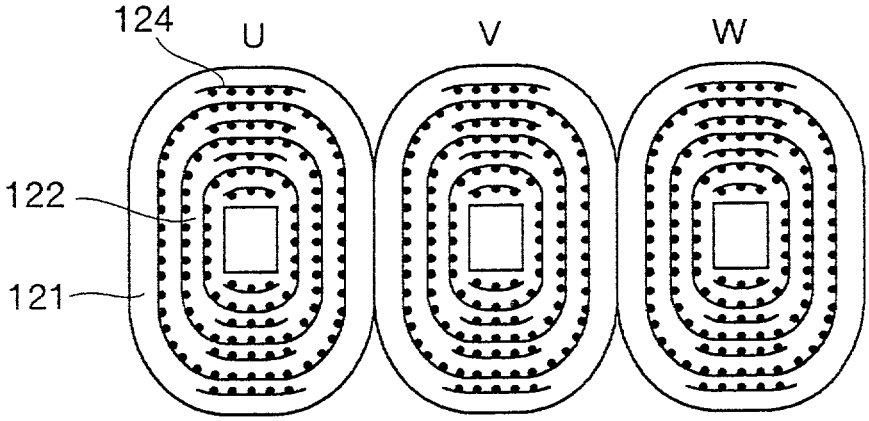
Figure 4C:
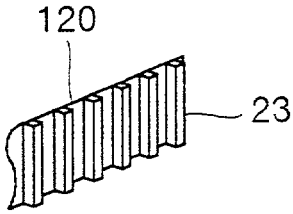
Figure 5A:
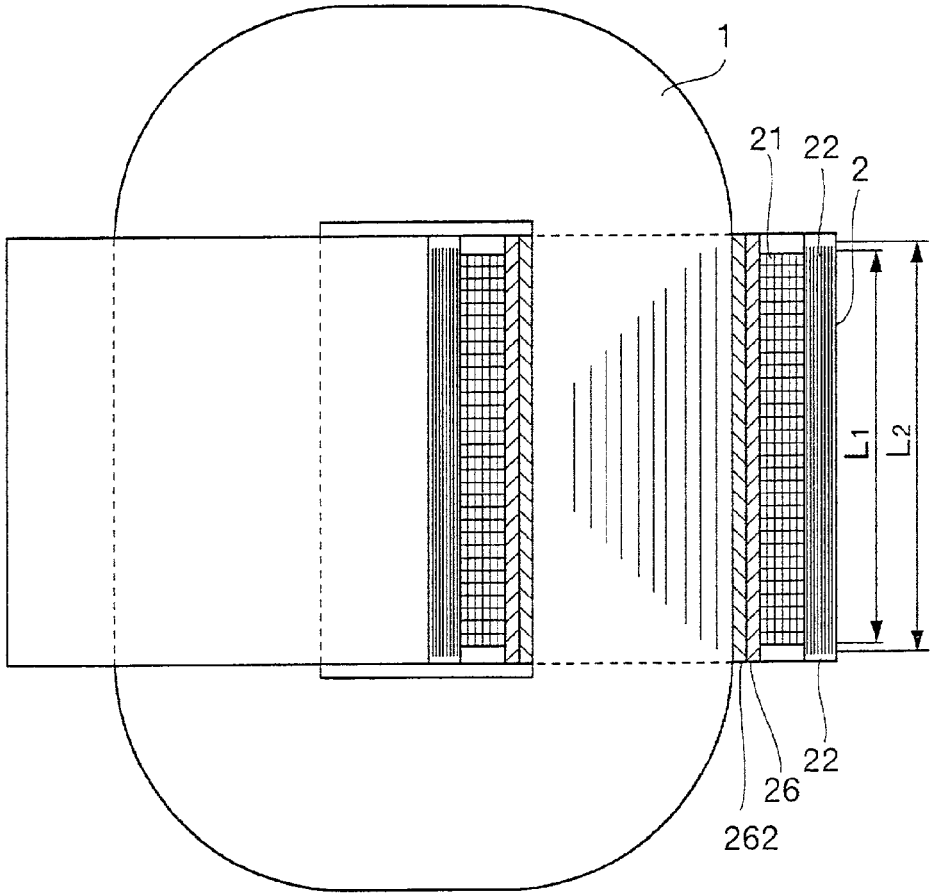
FIG. 5A shows a cross-section of the coil assembled with the magnetic core.
Figure 5B:
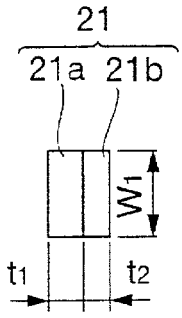
FIG. 5B shows a cross-section of the conductors in the primary coil.
Figure 5C:
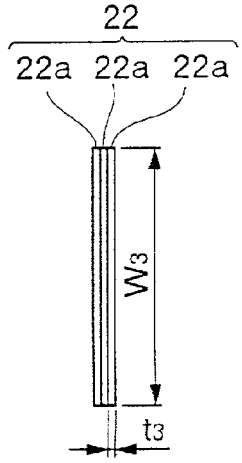
FIG. 5C shows a cross-section of the conductors in the secondary coil.
Figure 6:
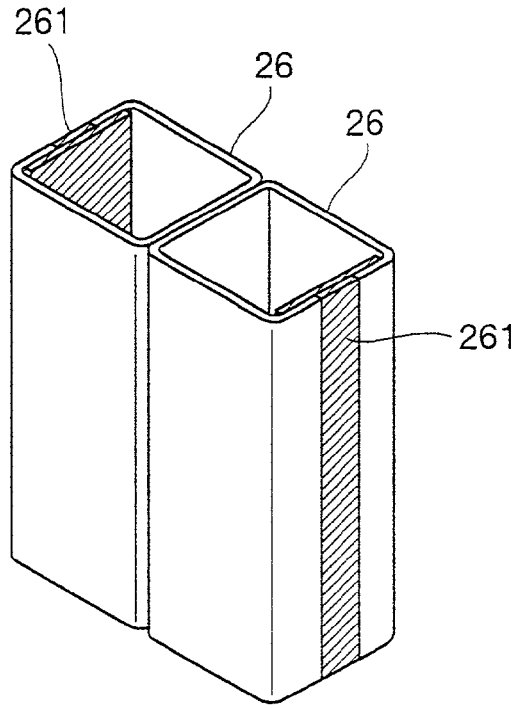
FIG. 6 shows a perspective view of a bobbin in the embodiment.

Each of the coils 2 includes a primary coil 21, a secondary coil 22 and a bobbin 26. The primary coil 21 employs different material from that of the secondary coil 22, i.e. the primary coil 21 employs a rectangular copper wire, and the secondary coil 22 employs an aluminum strip. The primary coil 21 uses two types of rectangular copper wires, 2.6 mm×6.5 mm and 2.0 mm×6.5 mm, arranged in parallel as disclosed in FIG. 5B and having a conductor cross-sectional area of about 29.9 $mm^2$, and is wound 418 turns around the bobbin 26. The secondary coil 22 uses three aluminum strips of 1.70 mm×475 mm arranged in parallel as disclosed in FIG. 5C, having a conductor cross-sectional area of about 2420 $mm^2$, and is wound 13 turns. One example of the bobbin 26 is depicted in FIG. 6. The bobbin 26 is made of a material having a greater strength than that of the amorphous magnetic strip such as steel, steel alloy or a resin. In the present embodiment, since the bobbin 26 is made of silicon steel plate having an electrical conductivity, a slit is formed where an insulating member 261 is inserted on the bobbin 26 so as to prevent formation of one-turn coil. The secondary coil 22, as shown in FIG. 5A, is arranged outside the primary coil 21. This configuration provides safe transformer, since high voltage is applied to the primary coil 21. The current density of the primary coil 21 using copper conductor is approximately 0.72 $A/mm^2$ when calibrated into the current density in an aluminum conductor, and the current density of the secondary coil 22 is approximately 0.655 $A/mm^2$; thus the current density in the primary coil 22 is about 1.1 times as high as that in the secondary coil 22, when calibrated into the current density in an aluminum conductor. The coils 2 are connected to the line wire and led to the outside. In order to let out the heat generated inside the coils, duct space layers 24 are formed within the coils 2, as shown in FIG. 4A, for circulating insulation oil therein. In each of the duct space layers 24, a spacer members 120 having a plurality of rod-shaped members 23 shown in FIG. 4C, is inserted coaxially so as to form a C-shaped duct space. The amorphous metal core transformer of the present embodiment has a greater cross-sectional area of the coil conductors than the related art has (approximately 120% in the primary side, approximately 400% in the secondary side compared with the related art), electrical resistance of the conductors is lower, and the calorific value is smaller thanks to small losses. As the cross-sectional area of the secondary side, where the amperage is large, is approximately 400% of that of the related art, a decrease in calorific value accompanied by a substantial reduction in resistance can be achieved. In the magnetic core-coil assembly 3, unit cores are arranged on the upper and lower sides of the coils 2 at parts 25. Duct spaces 24 can be eliminated within the parts 25, since substantially no circulation of insulating oil is induced between the cores and the coils impeded by the narrow gaps therebetween. For this reason, coils inserted into U-phase leg (second leg) 112 and W-phase leg (fourth leg) 114, no duct space is disposed within the parts 25 of the coils 21 and 22. Similarly, no duct space is disposed within the parts 25 of the coil inserted into V-phase leg (third leg) 113. On the other parts than the parts 25 on coil ends of the coils 2, a plurality of C-shaped duct spaces 24 are provided. Since heat generated in the coils 2 is reduced, overall configuration of the duct space is reduced, whereby the radial dimension of the coils 2 can be reduced. Therefore, the width of the magnetic core window, where the coil 2 is inserted, can be narrowed, and the dimensions of the unit core 11 can also be reduced, which enables to lighten the weight of unit core 11 as well.

In the amorphous metal core transformer of the present embodiment, the secondary coil 22 is made of aluminum strips, which helps to improve the workability of coil winding. Incidentally, aluminum has a lower density and a higher electrical resistance than copper, which boosts volume when used for a coil. For this reason, it is preferable to reduce the amount of aluminum conductor used, and it is recommended to use it only for the secondary coil 22 outside. The conductor cross-sectional area of the primary coil 21 is about 1.2 times larger than that of the related art. The conductor cross-sectional area of the secondary coil 22 is about 4.0 times larger than that of the related art. These larger conductor cross-sectional areas reduce the resistances of the coils 21 and 22, which reduces watt losses in the amorphous metal core transformer consequently. Moreover, Δ—Δ connection system of coils 2 in the present embodiment reduces the cross-sectional area of coil conductor approximately to $1/\sqrt{3}$ compared with Y-Δ connection systems. This enables to use a wire with smaller diameter, and since radius of bending can be reduced, winding the coil conductor on the bobbin becomes easier, resulting in a compact coil and improvement of the workability in winding coils. And, as the coils 2 are wound around the bobbin 26 having a greater strength than the amorphous magnetic strip, the work of winding the primary coil 21 composed of rectangular copper conductor wires and the secondary coil 22 composed of aluminum strips is facilitated. Furthermore, magnetic characteristic of the unit cores 11 composed of amorphous magnetic strip are subject to degradation by the compressive force resulting from deformation caused by the elasticity of the material of the coils 2, or deformation caused by electromagnetic force. However, since the unit magnetic cores 11 are inserted into a bobbin spacer 262 inside the bobbin 26, the degradation of magnetic characteristics caused by the compression force is circumvented, and watt losses in the amorphous metal core transformer is reduced. In the amorphous metal core transformer of the present embodiment, the primary coil has higher current density than that in the secondary coil when calibrated into the current density in an aluminum conductor. Therefore, though the calorific value generated in the primary coil is greater than that in the secondary coil, as the magnetic cores are present inside the primary coil with the bobbin in-between, and the magnetic cores serve as the coolant to absorb the heat generated from the primary coil, the temperature increase in the primary coil can be prevented. In addition, in the amorphous metal core transformer of the present embodiment, the connection between the secondary coil 22 and the wire, as it is between aluminum and aluminum, is easy to accomplish.

As shown in FIG. 5A, the length ($L_2$) in the axial direction of the secondary coil 22 is made greater than the length ($L_1$) in the axial direction of the primary coil 21. This enables to reduce deformation caused by electromagnetic force due to short-circuit current, even when the two coils 21 and 22 are disposed in such a manner that the centers of the electromagnetic forces coincide. Incidentally, watt losses in the transformer can be reduced by increasing the cross-sectional area of the wires used for the coils 2. Rectangular wire, strip, round wire can be employed as a wire in the coils 2. Use of a plurality of strands in parallel contributes to improvement in processability and easy winding. In FIG. 5B, one example of the primary coil 21 composed of two rectangular wires 21*a* and 21*b* of respectively $t_1$ and $t_2$ in thickness and $w_1$ in width is depicted. In FIG. 5C, one example of the secondary coil 22 composed of three strips 22*a* of $t_3$ in thickness and $w_2$ in width is depicted. In addition to the reduction of watt losses, disposing the duct spaces 24, where insulation oil flows through, within the coils 2 reduces the temperature rise caused by the heat generated inside. Thus, coils 2 with low temperature rise is provided. Further, in the present embodiment, by combining or assembling the coils and the amorphous five-legged core, the magnetic core-coil assembly with low temperature rise is provided.

The amorphous metal core transformer of the present embodiment is for three phase 1000 kVA, 50 Hz use in which core losses are approximately 305 W and watt losses are approximately 7730 W, resulting in total losses of approximately 8035 W. The amorphous metal core transformer of the present embodiment can reduce core losses, watt losses and total losses more than an amorphous metal core transformer in the related art. It also suppresses the temperature increase of the transformer, which realizes an amorphous metal core transformer with smaller cooling area.

Not only in the amorphous metal core transformer of three phase 1000 kVA, 50 Hz use described in the embodiment, but also in a transformer of different capacities, more reduction in core losses, watt losses and total losses can be achieved by present invention. For example, in a transformer of 750 kVA use, core losses will be approximately 255 W, watt losses, approximately 5790 W and total losses, approximately 60455 W, in a transformer of 500 kVA use, core losses will be approximately 240 W, watt losses approximately 2860 W and total losses approximately 3100 W, and in a transformer of 300 kVA use, core losses will be approximately 185 W, watt losses, approximately 1580 W and total losses, approximately 1765 W. The losses are reduced in every case.

As for the current density calibrated due to difference of the electrical resistance of conductor materials in the coil (hereinafter equivalent current density), the ratio of the equivalent current density in the primary coil to that in the secondary coil is 1.1 (i.e. the equivalent current density in the primary coil is 1.1 times higher than that in the secondary coil) in the 1000 kVA use transformer in the present embodiment. As for the transformers of different capacities, the ratio is 1.2 in the transformer of 750 kVA use, and is 1.53 in the transformer of 500 kVA. Anyway, it is desirable to set the equivalent current density in the primary coil higher than that in the secondary coil. The preferable value of the ratio of the equivalent current density in the primary coil to that in the secondary coil is 1.05 or higher.

One example of the assembling method for the magnetic core-coil assembly 3 of the present embodiment will be described referring to FIGS. 7 to 9. The magnetic core-coil assembly 3 obtained by this assembling method has a configuration in which the unit wound cores 11 are inserted into the coils 2 disposed in a row.

FIG. 7 is a schematic diagram of the unit iron core 11 after annealing. The core 11 is formed in an inverted U shape with the joint portion opened. A reinforcement member 15 is provided on the inner circumference of the core 11 and a reinforcement member 16 made of a silicon steel plate is provided on the outermost circumference of the core 11. Moreover, the insulating members 14 and 12 are adhered so as to cover surfaces of the core 11 except the joint portion for protecting its edges of the yoke portion and leg portion.

Assembling process of the unit cores 11 into the coils 2, i.e., steps (a) to (g), will be explained with reference to FIG. 8.

Figure 8:
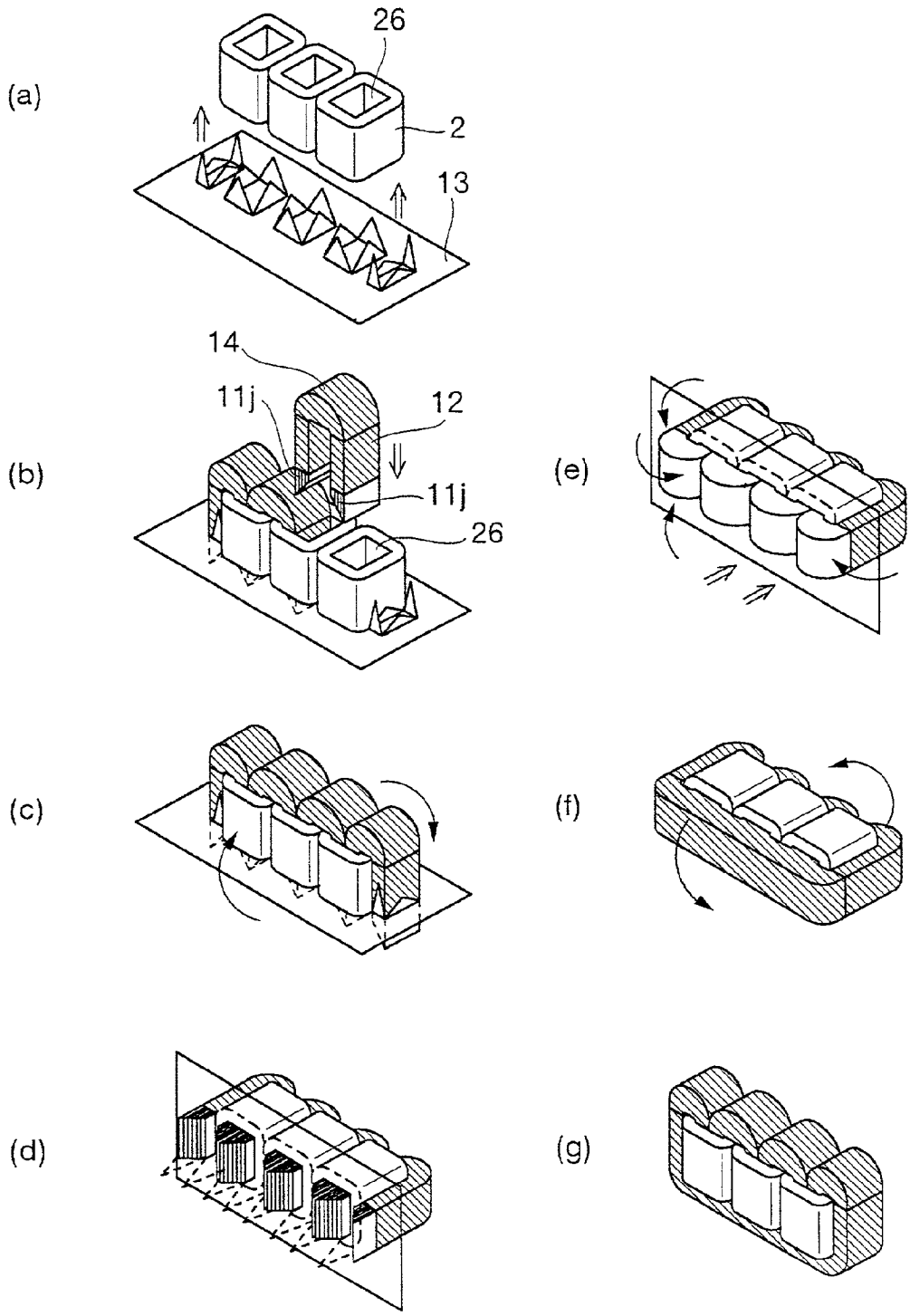
FIG. 8 shows diagrams illustrating one example of assembling process for the amorphous metal core transformer in the embodiment.

At step (a), on the end surface of the coils 2 (i.e. lower end portions of the coils 2 in FIG. 8(*a*)), the protective member 13 is adhered to the insulating member on the innermost circumference of the coils or the bobbin 23. No gap is formed between the protective member 13 and the insulating member on the innermost circumference of the coils or the bobbin 23. On the protective member 13, notches C1 for inserting the unit core 11 are provided as disclosed in FIG. 13.

At step (b), the unit magnetic cores 11 formed in the inverted U shape are inserted into the protective member 13 through the coil windows 26 as shown in (b) of FIG. 8. The protective member 13 is made of insulating material and may be either a single continuous member or a continuous member formed by sticking together a plurality of split parts with adhesive tape.

At step (c), the insertion of the unit magnetic cores 11 is completed as shown in FIG.8.

At step (d), the magnetic cores 11, the coils 2 and the protective member 13 are turned so that the surface of said protective member 13 be vertically oriented as shown in FIG. 8. Then the joint portions 11*j* of the inverted U-shaped cores 11 are closed so as to form butted joints in the yoke portion.

At step (e), as disclosed in FIG. 8, the yoke portions including the joint portions 11*j* of the magnetic cores 11 are covered by the protective member 13. The protective member 13 is folded so as to cover the yoke portions of the magnetic cores 11. No gap is formed between the protective member 13 and the insulating member on the innermost circumference of the coils or the bobbin 23 to prevent amorphous fragments from entering inside the coils 2.

At step (f), as shown in FIG. 8, the yoke portions of magnetic cores 11 are wrapped with the protective member 13, and amorphous fragments are prevented from falling off.

At step (g), as shown in FIG. 8, the unit magnetic cores 11 configured as described above are erected and thereby completed.

Figure 9:
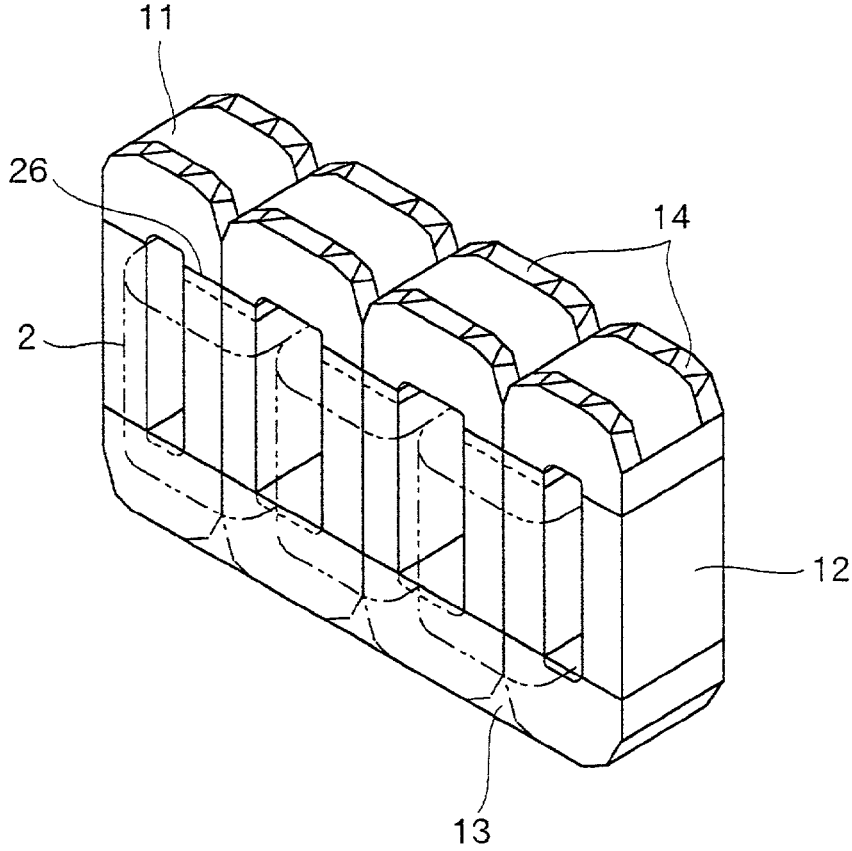
FIG. 9 shows a perspective view of metal core-coil assembly in the embodiment.

By the steps (a) through (g) described above, the magnetic core-coil assembly disclosed in FIG. 9 is obtained.

A second modified example of the method for assembling the magnetic core-coil assembly will be described with reference to FIG. 13.

Figure 13:
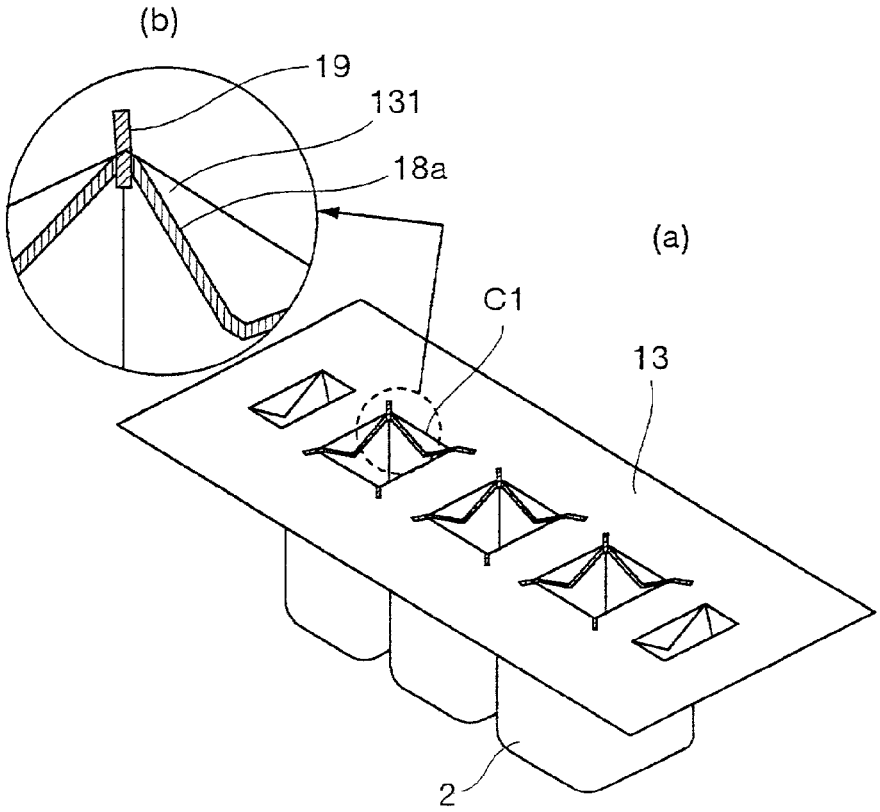
FIG. 13 shows a perspective view of protection member in the embodiment.

FIG. 13 discloses an example of a method for sticking the protective member 13 to the insulating member on the innermost circumference of the coil or the bobbin 23. As disclosed in (a) of FIG. 13, five notches C1 corresponding to five legs are formed in the protective member 13 made of rectangular-shaped insulating material. In FIG. 13, (*b*) is a magnified view of the notch C1.

In FIGS. 13, (*a*) and (*b*), a piece of the triangular insulating material emerging in the notch C1 is folded downward to form an angular part 131. This angular part 131 is stuck to the innermost circumference of the coil or the bobbin 23 with an adhesive tape 18*a*, such as a kraft paper tape, so as to form no gap between the angular part 131 and the innermost circumference of the coil or the bobbin 23. Further, it is preferable to stick an adhesive tape 19 to the inside corners of the coil window for reinforcement. Furthermore, instead of using the adhesive tape 19, attaching may be accomplished with glue.

Figure 10:
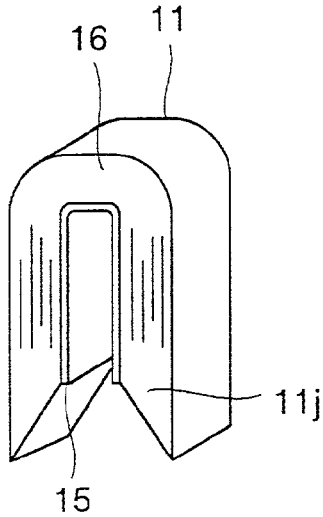
FIG. 10 shows a perspective view of unit core in the embodiment.

One modified example of the method for assembling the magnetic core-coil assembly 3 will be described with reference to FIGS. 10 to 12. Referring to FIG. 10, in this modified example, protection members of an insulating material are provided on the upper and lower end surfaces of the coils 2.

In FIG. 10, an unit core 11 formed in the inverted U shape by opening the joint portion after annealing is disclosed. A reinforcing member 15 for providing strength to the unit core 11 is provided on the innermost circumference, and a reinforcing member 16 of a silicon steel plate is provided on the outermost circumference.

Figure 11:
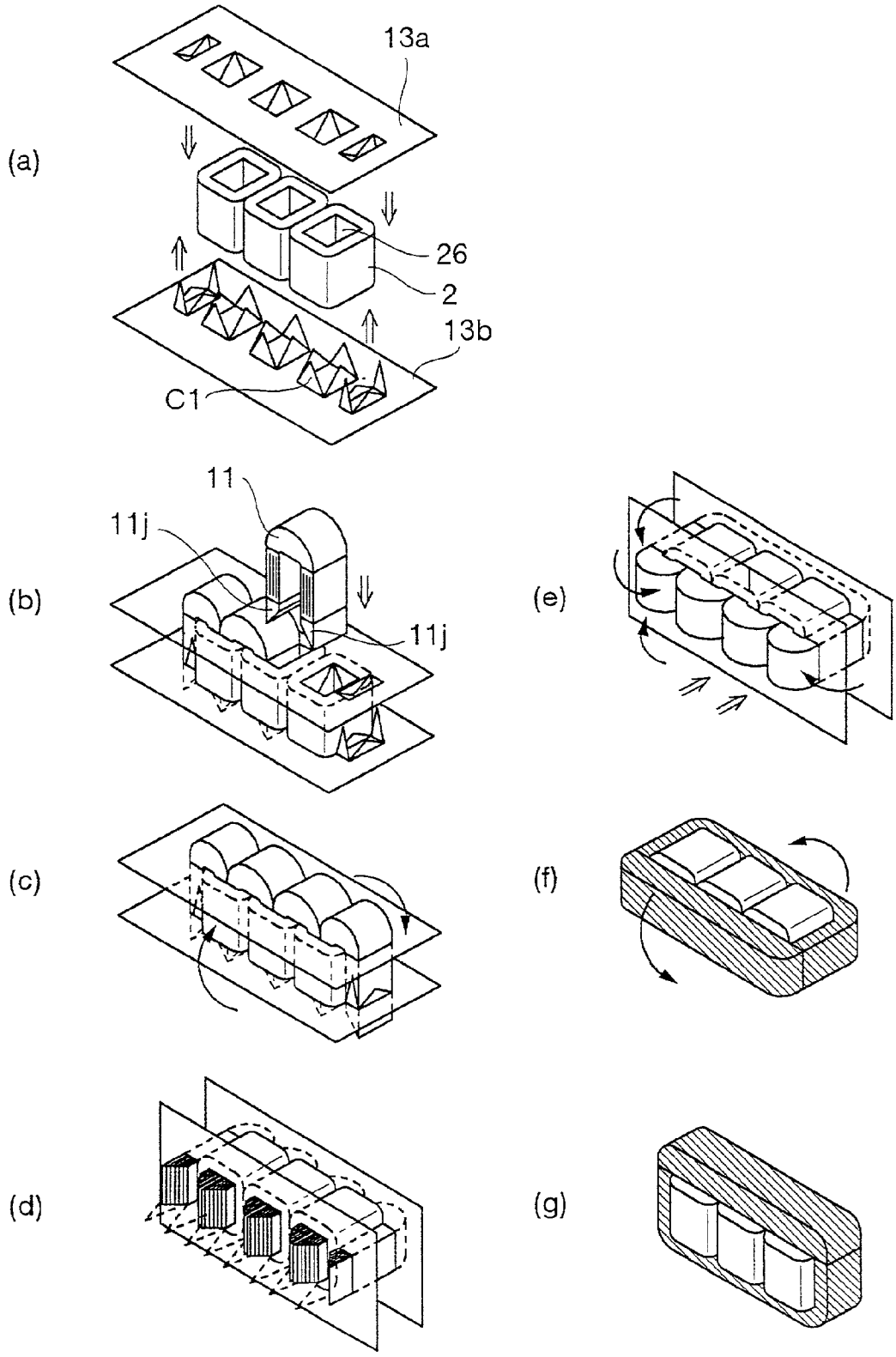
FIG. 11 shows diagrams illustrating a modified example of assembling process for the amorphous metal core transformer.

Referring to FIG. 11, steps to insert the unit magnetic cores 11 of FIG. 10 into the coils 2 are disclosed.

At step (a), as shown in FIG. 11, on both end surfaces of the coils 2, two protective members 13 are adhered to the insulating members on the innermost circumference of the coils or the bobbins 23. No gap is formed between the protective members 13*a*, 13*b* and the insulating members on the innermost circumference of the coils or the bobbins 23. Each of the protective members 13*a* and 13*b* has the same configuration as the protective member 13 shown in FIG. 13. On the protective member 13*a*, 13*b* notches C1 for inserting the unit core 11 are also provided as disclosed in FIG. 13.

At step (b), the unit magnetic cores 11 formed in the inverted U shape are inserted into the protective members 13*a*, 13*b* and the coil windows 26 as shown in FIG. 11. The protective members 13*a*, 13*b* are made of insulating material and may be either a single continuous member or a continuous member formed by sticking together a plurality of split parts with adhesive tape.

At step (c), the insertion of the unit magnetic cores 11 is completed as shown in FIG. 11.

At step (d), the magnetic cores 11, the coils 2 and the protective members 13*a*, 13*b* are turned so that the surface of said protective members 13*a*, 13*b* be vertically oriented as shown in FIG. 11. Then the joint portions 11*j* of the inverted U-shaped cores 11 are closed so as to form butted joints in the yoke portion.

At step (e), as shown in FIG. 11, the yoke portions including the joint portions 11*j* of the magnetic cores 11 are covered by the protective member 13*b*. The yoke portions without the joint portions 11*j* of the magnetic cores 11 are covered by the protective member 13*a*. The protective members 13*a*, 13*b* are folded so as to cover the yoke portions of the magnetic cores 11. No gap is formed between the protective members 13*a*, 13*b* and the insulating members on the innermost circumference of the coils or the bobbins 23 to prevent amorphous fragments from entering inside the coils 2.

At step (f), as shown in FIG. 11, the yoke portions of magnetic cores 11 are wrapped with the protective members 13*a*, 13*b*, and amorphous fragments are prevented from falling off.

At step (g), as shown in FIG. 11, the unit magnetic cores 11 configured as described above are erected and thereby completed.

Figure 12:
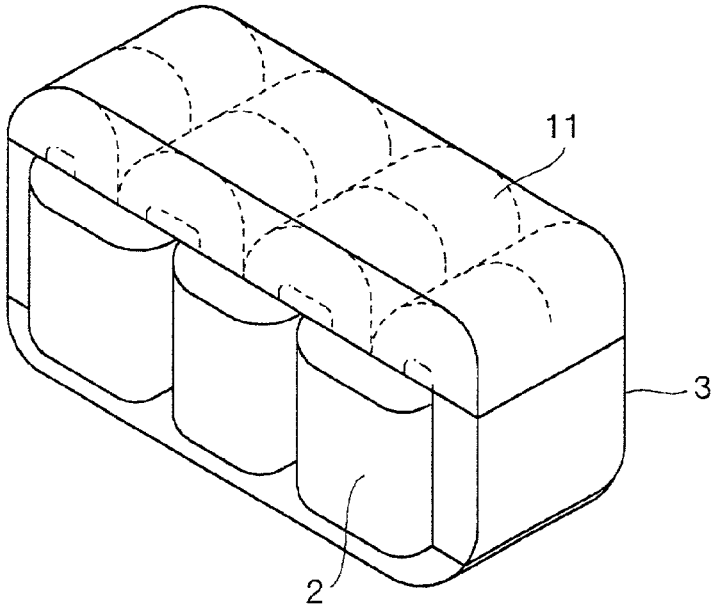
FIG. 12 shows a perspective view of magnetic core-coil assembly manufactured in the modified assembling process of the embodiment.

By the steps (a) through (g) described above, the magnetic core-coil assembly shown in FIG. 12 is obtained.

Figure 14:
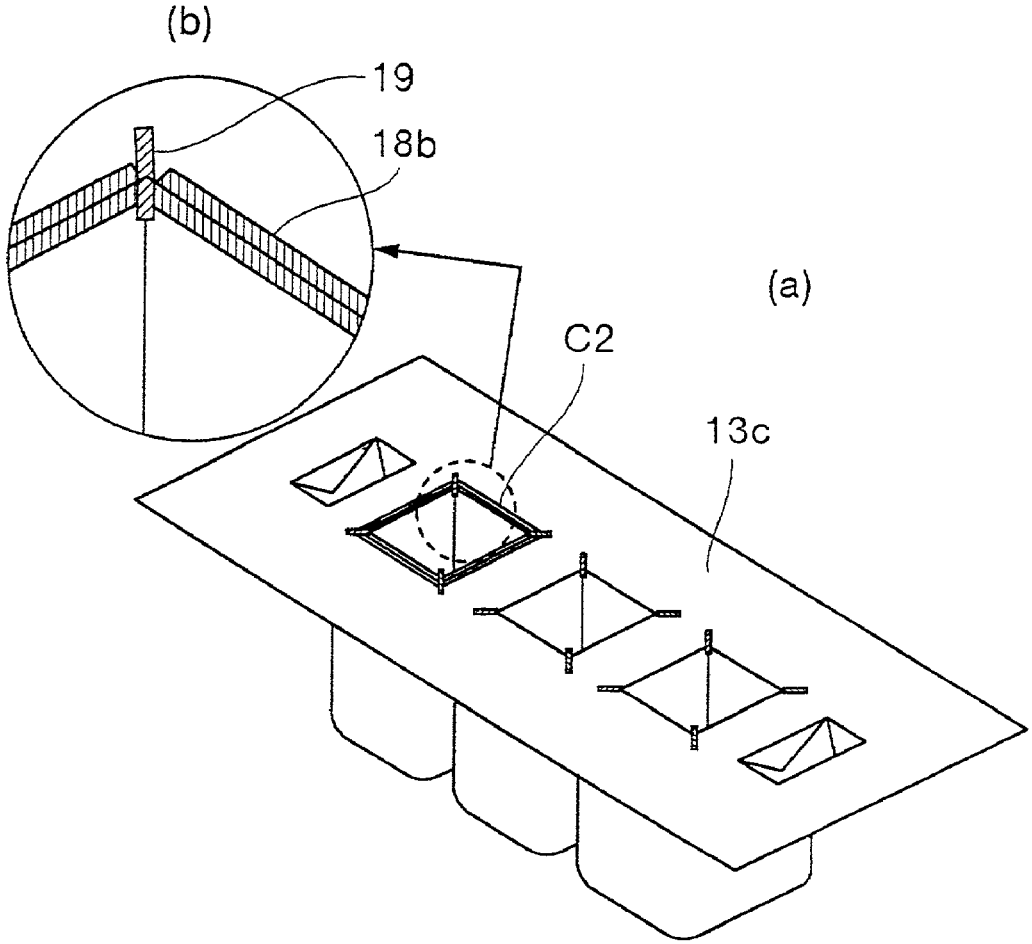
FIG. 14 shows a perspective view of the modified protection member in the embodiment.
Figure 15:
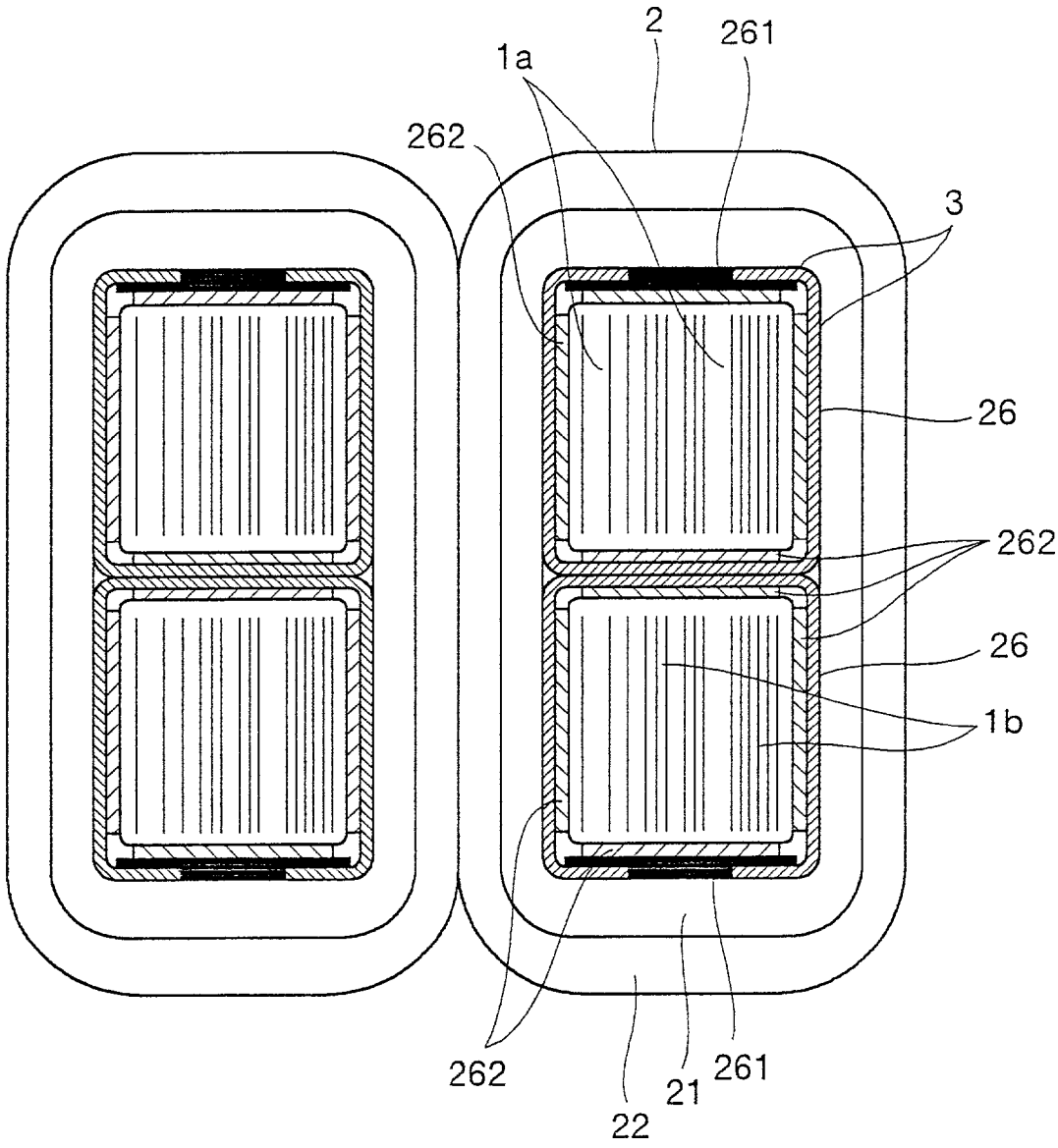
FIG. 15 shows a diagram illustrating one example of single phase amorphous metal core transformer in the present invention.

Next, One modified example of the protective member is explained referring to FIG. 14. This example shows another method for sticking the protective member 13*c* to the insulating member on the innermost circumference of the coil or the bobbin 3.

As shown in (a) of FIG. 14, in the protective member 13*c* made of a rectangular insulating material, five notches C2 shaped as a coil window are formed. In FIG. 14, (b) is a magnified view of the notch C2.

As illustrated, the notches C2 are aligned to the edge part of the coil window. The protective members 13*c* are stuck to the insulating member on the innermost circumference of the coil or the bobbin 23 with an adhesive tape 18*b* at the notches C2. The adhesive tape 18*b* is a kraft paper tape for instance. No gap is formed between the notches C2 and the innermost circumference of the coil or the bobbin 23. In addition, the adhesive tape 19 may be stuck to the inside corners of the coil window for reinforcement.

This invention is not limited to the above-described embodiments. It is also applied to an amorphous wound core transformer having three legs or more, with necessary modification. This invention is also applied to any transformer having a core configuration in which a plurality of unit magnetic cores 11 are arranged in two or more rows in the widthwise direction of the cores. In this case, a plurality of unit cores arranged in rows in the widthwise direction of the cores may be covered with a protecting material row by row, each row being treated collectively, or all the rows may be covered with a protecting material collectively.

According to the above-described methods for assembling the magnetic core-coil assembly, an amorphous metal core transformer capable of improving insulating performance by preventing amorphous fragments from scattering.

Next, the transformer casing 4, if it is provided with cooling fins 42 outside, can reduce the temperature rise in the transformer. In the amorphous metal core transformer of the present embodiment, smaller watt losses than that in a conventional amorphous metal core transformer resulting in less temperature rise enables to reduce the cooling area by lowering the height of fins or reducing their number. For example, since the height of the cooling fins 42 may be within the range of 17 mm to 280 mm, the height can be reduced by approximately 20% compared with the conventional amorphous metal core transformer. The total surface area of the cooling fins is set to between 0 $m^2$ and 100 $m^2$. In addition, as the surface of the transformer casing also has a role in cooling, the total surface area of the cooling fins and the transformer casing is preferably 130 $m^2$ or less. Incidentally, the cooling fins can also serve as ribs to enhance the strength of the transformer casing. And the transformer casing 4 accommodates the magnetic core-coil assembly 3 and insulating oil inside, and has external terminals 41 outside. Insulating oil, not to contain any gas, should be deaerated beforehand or saturated with nitrogen gas after deaeration. The external terminals 41 are connected by the coils 2 and line wires. The cooling fins discharge the heat generating from the coils 2 and other internal sources into the atmosphere.

In addition, The present invention is also applied to an amorphous metal core transformer with molded resin coils. Furthermore, it is also applied to a single phase transformer as disclosed in FIG. 15. This single phase amorphous metal core transformer has an magnetic core-coil assembly 3, magnetic cores1 and coils 2, and the coils 2 have a primary coil 21, a secondary coil 22, a bobbin 26, and a bobbin spacer 262. In the bobbin 26, an insulating member 261 is inserted into a slit in order not to form a one-turn coil.

According to the present invention, as the temperature rise within the transformer can be restrained, magnetic cores and coils can be operated at a relatively low temperature, so that smaller cooling fins can be used, and accordingly the amorphous metal core transformer that facilitates wiring work in coil winding can be obtained.

This concludes the description of the preferred embodiments. Although the present invention has been described with reference to a number of illustrative embodiments thereof, it should be understood that numerous other modifications and embodiments can be devised by those skilled in the art that will fall within the spirit and scope of the principles of this invention. More particularly, reasonable variations and modifications are possible in the component parts and/or arrangements of the subject combination arrangement within the scope of the foregoing disclosure, the drawings and the appended claims without departing from the spirit of the invention. In addition to variations and modifications in the component parts and/or arrangements, alternative uses will also be apparent to those skilled in the art.

What is claimed is:

1. An amorphous metal core transformer comprising:

a magnetic core composed of a plurality of amorphous metal strips;

a primary coil of a copper conductor material wound on said magnetic core; and a secondary coil of an aluminum conductor material wound on said primary coil and disposed outside said primary coil in a radius direction of said primary coil, wherein an amount of heat generated by a current flowing through said primary coil is greater than an amount of heat generated by a current flowing through said secondary coil, so that the heat generated from the primary coil is dissipated in said magnetic core and in said secondary coil and;

said secondary coil has a greater length than a length of said primary coil in an axial direction of the primary and secondary coils.

2. An amorphous metal core transformer according to claim 1, wherein said primary employs a rectangular copper wire, and said secondary coil employs an aluminum strip wire.

* * * * *